United States Patent [19]

Rasmussen et al.

[11] Patent Number: 4,487,375

[45] Date of Patent: Dec. 11, 1984

[54] ROLL TRANSFER MECHANISM FOR WEB MATERIAL DISPENSER

[75] Inventors: Holger Rasmussen, Kilchberg, Switzerland; Paul W. Jespersen, Houston, Tex.; Raymond F. DeLuca, Stamford, Conn.

[73] Assignee: Georgia-Pacific Corporation, Atlanta, Ga.

[21] Appl. No.: 466,950

[22] Filed: Feb. 16, 1983

[51] Int. Cl.[3] ..... B65H 19/00

[52] U.S. Cl. ..... 242/55.3; 226/174

[58] Field of Search ..... 242/55.3, 55.53, 66, 242/67.1; 226/174, 168, 91, 109, 110, 121; 312/38, 39, 40; 225/2, 4, 96, 101, 106

[56] References Cited

U.S. PATENT DOCUMENTS

| | | | |
|---|---|---|---|
| Re. 28,911 | 7/1976 | Jespersen et al. | 225/96 |
| 2,930,664 | 3/1960 | Leibisch | 312/39 |
| 3,250,484 | 5/1966 | Fair | 242/66 |
| 3,288,387 | 11/1966 | Craven, Jr. | 242/55.53 |
| 3,575,328 | 4/1971 | Jespersen et al. | 225/2 |
| 3,851,810 | 12/1974 | Jespersen | 226/121 |
| 3,917,191 | 11/1975 | Graham, Jr. et al. | 242/55.3 |
| 4,106,684 | 8/1978 | Hartbauer et al. | 226/91 |
| 4,165,138 | 8/1979 | Hedge et al. | 312/39 |
| 4,203,562 | 5/1980 | DeLuca et al. | 242/55.3 |
| 4,236,679 | 12/1980 | Jespersen | 242/55.53 |
| 4,358,169 | 11/1982 | Filipowicz et al. | 312/39 |
| 4,403,748 | 9/1983 | Cornell | 242/55.53 |

*Primary Examiner*—Leonard D. Christian
*Attorney, Agent, or Firm*—Banner, Birch, Mckie & Beckett

[57] ABSTRACT

A dispenser for multiple rolls of web material such as paper toweling that is provided with dispensing mechanism to lead a web of material out of the dispenser to the user has supports for rotatably supporting rolls in primary and reserve positions, respectively, with transfer mechanism interactive with such roll supports and the dispensing mechanism to automatically transfer web feed from one roll to the other under predetermined sensed conditions. The transfer mechanism includes a pivotally mounted transfer frame swingable to be out of the way to facilitate dispenser loading with the dispenser cabinet cover open, the transfer frame being releasibly retained out of the way in conjunction with dispenser loading, and movable to a sensing location upon closure of the cabinet cover whereat depletion of web material supplied from the roll in the primary position is sensed whereafter the frame again shifts for tucking fingers on the transfer frame to press a web end portion of the reserve roll web material into the dispensing mechanism to thereafter feed web material from such reserve roll. A keeper bracket loosely receives this web end portion incident dispenser loading with the action of cabinet cover closing causing the bracket to firmly grip such portion until the transfer mechanism coacts with the dispensing mechanism to thereafter feed web material supplied from the reserve roll.

10 Claims, 7 Drawing Figures

ROLL TRANSFER MECHANISM FOR WEB MATERIAL DISPENSER

BACKGROUND OF THE INVENTION

This invention relates to the field of flexible sheet material dispensers and more specifically to dispensers for handling multiple rolls of web material such as paper toweling and the like.

The prior art is replete with dispenser constructions for handling rolls of flexible sheet material such as paper toweling. Indeed, web material dispensers that hold a multiple of such flexible material rolls are known in the art where at least one reserve roll is held in the dispenser cabinet in a non-dispensing position while web material from an initial roll located in the dispensing position within such cabinet is being dispensed to the user. Characteristically, such multiple roll dispensers include mechanism to move the reserve roll into a dispensing position when the initial roll of material is depleted.

The flexible web material coming from the roll may be led from the dispenser to be supplied to the user by a number of different means, usually incorporating at least a pair of rollers between which the web material passes. The web material may be manually withdrawn by the user and manually torn off against a serrated cutting blade mounted near the web material outlet of the dispenser, a manually operated crank may drive the rollers to feed out the sheet material to be cut off by being drawn against such a serrated blade or the dispenser may have a rotatably mounted knife within the dispensing mechanism cooperating with a slot in a rotatable roller adjacent this knife for the sheet material to be severed or perforated to be more easily torn off by the user. Many dispensers for flexible rolled material include means to measure a desired length of the web dispensed to the user to control the length of web, such as paper toweling, dispensed in each operating cycle of the dispenser.

However, whatever type of dispensing mechanism that is employed in guiding the web of sheet material from its roll and out of the dispenser, in multiple roll dispensers, a problem is encountered in effectively and reliably picking up the leading end of the sheet material web on the reserve roll to feed this leading end into the dispensing mechanism after depletion of the initial roll being dispensed from within the dispenser cabinet.

In multiple roll dispensers this problem of transferring feed to web material coming from a reserve roll after the web material has been depleted from an initial roll has been approached in a number of different ways. Some solve the problem by simply requiring a servicing attendant to reopen the dispenser cabinet and load in a fresh reserve roll when an indicator on the dispenser alerts the attendant that the roll being dispensed is nearly depleted. Obviously, this solution calls for the constant expense and attention of a servicing attendant for the dispenser.

Where dispensers have attempted loading multiple rolls into a single cabinet and the web material is to be dispensed from the rolls in succession, the problem of reliably picking up the lead end of the material on each reserve roll by the dispensing mechanism so that the web is made available to the user at the exterior of the dispenser has not been effectively resolved. Such dispensers in the prior art have involved complicated and expensive structures to get the leading end of web material on a reserve roll into the dispensing mechanism. Further, their complications have added to the difficulties in being easily and effectively threaded by service attendants unfamiliar with the complicated structure of the dispensing mechanism. These structures add to the manufacturing expense and their complexity contributes to costly maintenance with a high rate of breakdown and failure during any reasonable operating life expectancy.

SUMMARY OF THE INVENTION

The above-mentioned problems present in the prior art involving dispensing sheet material from multiple rolls in succession is solved by the present invention utilizing a rather simple and inexpensive construction. The invention enables loading full rolls of web material in primary and reserve dispensing positions with assurance that the leading end of web material on the roll in the reserve dispensing position will be picked up by the dispensing mechanism and effectively led to the dispenser's exterior for accessibility to the user after the web material on the roll in the primary dispensing position has been depleted.

In the instant invention, a primary roll of web material is rotatably carried within the dispenser with the web material thereof being threaded through the dispensing mechanism to the dispenser exterior for user removal as part of loading this primary roll in the dispenser. A reserve roll of web material is also loaded but in a reserve dispensing position incident carrying out the dispenser loading operation. A transfer mechanism is interactive with the rolls supports and the dispensing mechanism to automatically transfer web feed from the primary roll to the reserve roll when web depletion of the primary roll material is sensed.

This transfer mechanism includes a pivotally mounted transfer frame swingable to be out of the way to facilitate dispenser loading with the conventional dispenser cabinet cover in open position. The transfer frame is releasably retained to remain in out-of-the-way locations in conjunction with dispenser loading. Closure of the cabinet cover frees the transfer frame to move to a sensing location whereat depletion of web material supplied from the roll in primary dispensing position is sensed. When this depletion is sensed, the transfer frame again shifts to insert tucking fingers on the transfer frame into peripheral groves on mating rollers forming a part of the dispensing mechanism. This presses a web end portion of the reserve roll web material into the dispensing mechanism rollers to thereafter feed web material from the roll in the reserve dispensing position.

The dispenser structure provides a keeper bracket which loosely receives the web end portion of the roll in reserve dispensing position as part of the dispenser loading operation. Thereafter, the action of closing the cabinet cover causes the keeper bracket to firmly grip this web end portion until the transfer mechanism coacts with the dispensing mechanism to thereafter feed web material supplied from the reserve roll.

Having the foregoing invention summary in mind, it is a principal object of the present invention to provide a dispenser for multiple rolls of web material wherein multiple rolls are rotatably supported in primary and reserve dispensing positions, respectively, with web material being dispensed from the primary roll and transfer mechanism being interactive with the supports for such rolls and the dispensing mechanism of the dispenser to automatically transfer web feed from the primary roll to the reserve roll upon depletion of web material on the primary roll being sensed.

A further important object of the invention is to provide a multiple roll dispenser in accordance with the above object wherein the transfer mechanism includes a transfer frame which is releasably retained out of the way in conjunction with loading the dispenser with rolls and movable to a sensing location upon closure of the cabinet cover whereat depletion of the web material from the primary roll is sensed.

Another object of the invention is to provide a multiple roll dispenser wherein the dispensing mechanism includes mating rollers at least one of which has an annular recess and wherein the transfer mechanism tucks a web end portion into such recess when web material depletion from the primary roll is sensed.

It is also an object of this invention to provide a multiple roll dispenser in line with the above objects wherein the web end portion of material on a reserve roll is held until the transfer mechanism is activated to feed web material from this reserve roll and this holding means is activated to firmly grip this web end portion by the act of closing the cabinet cover of the dispenser.

Other objects and advantages of this invention will become apparent upon consideration of the detailed description of a preferred embodiment thereof that is given in connection with the accompanying drawings.

DESCRIPTION OF A PREFERRED EMBODIMENT

Figure 1:
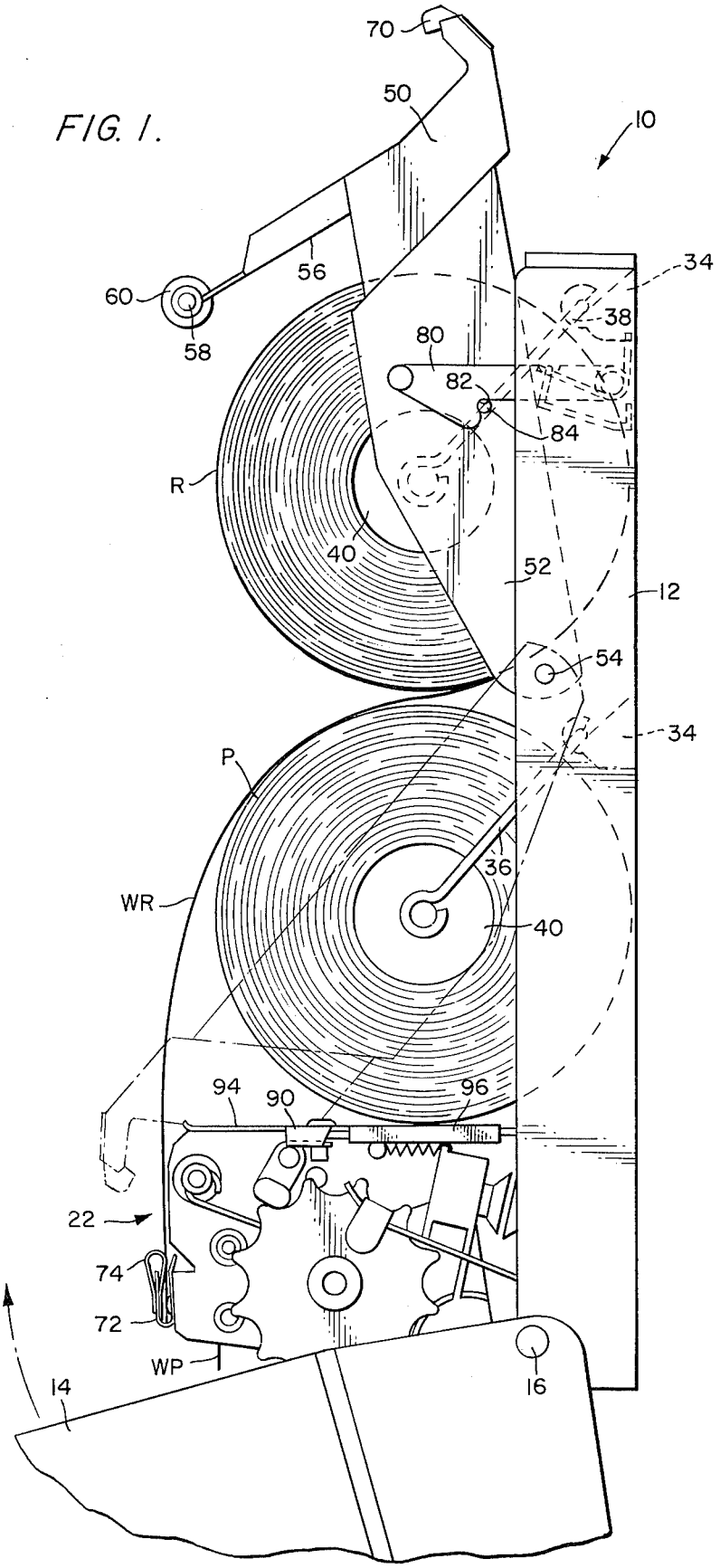
FIG. 1 is a side elevational view of the invention with the dispenser cabinet cover open and the transfer frame shown retained out of the way to facilitate dispenser loading.
Figure 3:
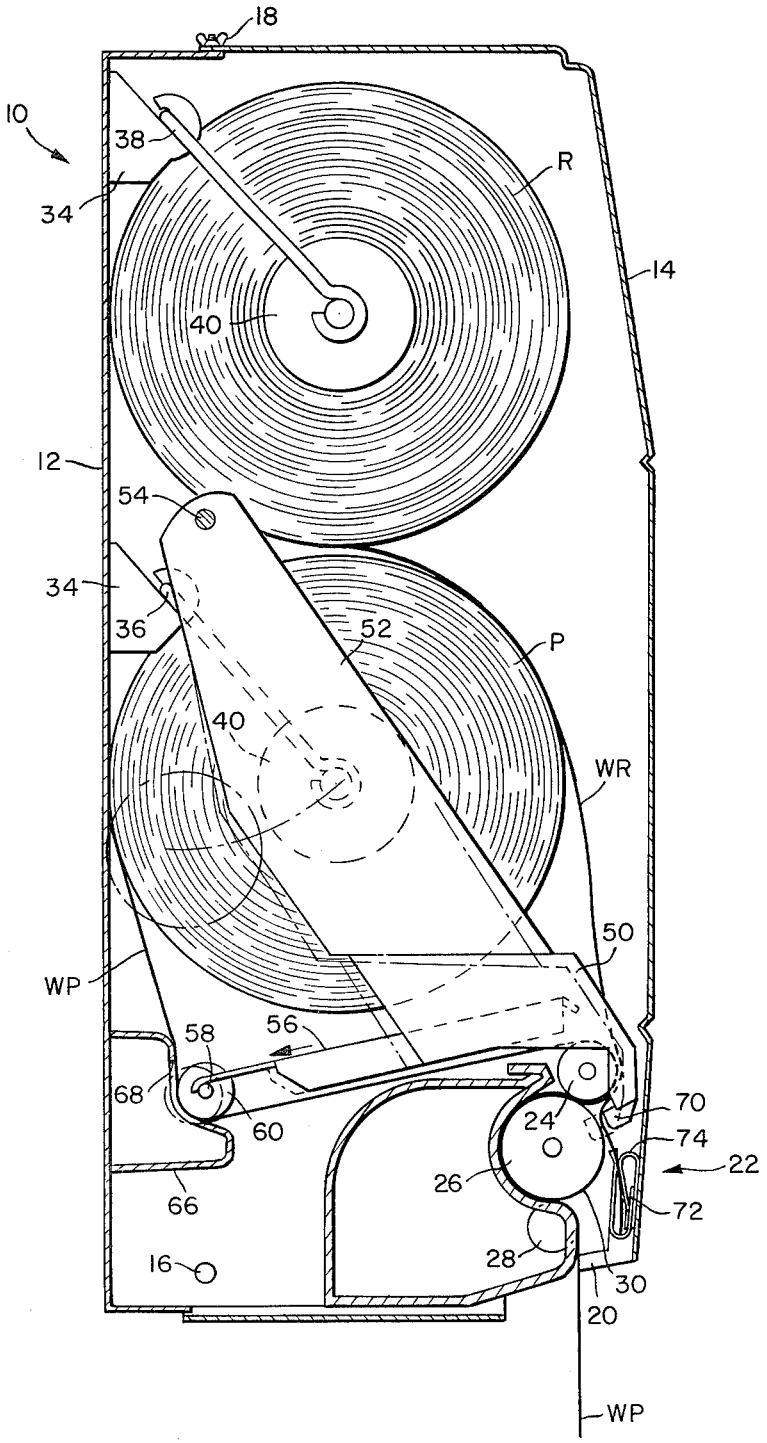
FIG. 3 is a sectional view taken on line 3—3 of FIG. 2.

By reference to FIGS. 1 and 3, the overall nature of the multiple roll dispenser 10 can be quickly perceived. In FIG. 1, the dispenser chassis 12 is shown with its cabinet cover 14 pivoted about its pivot 16 to open position on chassis 12 to facilitate loading. The dispenser is loaded with rolls of web material, such as paper toweling, the primary roll P being rotatably mounted in the primary dispensing position and the reserve roll R rotatably mounted in the reserve dispensing position. On the other hand, FIG. 3 shows the multiple rolls P and R within dispenser 10 with the cabinet cover 14 swung to its closed relation to dispenser chassis 12.

A conventional cover lock 18 is provided to retain the cover 14 closed relative to chassis 12. The cover lock 18 will normally be provided with a key that can be employed to release the cover 14 for it to swing open about pivot 16 on chassis 12 when replenishment of the rolls P and R of web material in the dispenser 10 is required.

As is conventional in dispensers for rolled web material, the cover 14 is provided with a transverse slot 20 opening along its lower end through which the web material supplied from the primary or reserve rolls P and R, respectively, passes out of the dispenser to be accessible to the intending use. The web material supplied from primary roll P is designated WP and the web material from reserve roll R is designated WR on the drawings.

The dispenser 10 has a web dispensing mechanism 22 carried at the lower end of chassis 12. The particular dispensing mechanism 22 is only diagramatically illustrated on the drawings. It need not be described in detail since mechanism 22, per se, does not form part of the invention except for the components of the dispensing mechanism which are described hereinafter and which interact with the transfer mechanism of the invention to automatically transfer web feed from the primary roll P to the reserve roll R when the transfer mechanism senses depletion of web material being supplied from primary roll P.

The construction features for a suitable dispensing mechanism 22 are fully disclosed in Jesperson, et al.. U.S. Pat. No. Re 28,911 issued July 20, 1976. Further structural details which may beneficially be incorporated in the dispensing mechanism 22 used with the dispenser 10 of the instant invention will be found by referring to Jesperson, et al., U.S. Pat. No. 3,575,328 patented Apr. 20, 1971, and Jesperson U.S. Pat. No. 3,851,810 patented Dec. 3, 1974.

Figure 5:
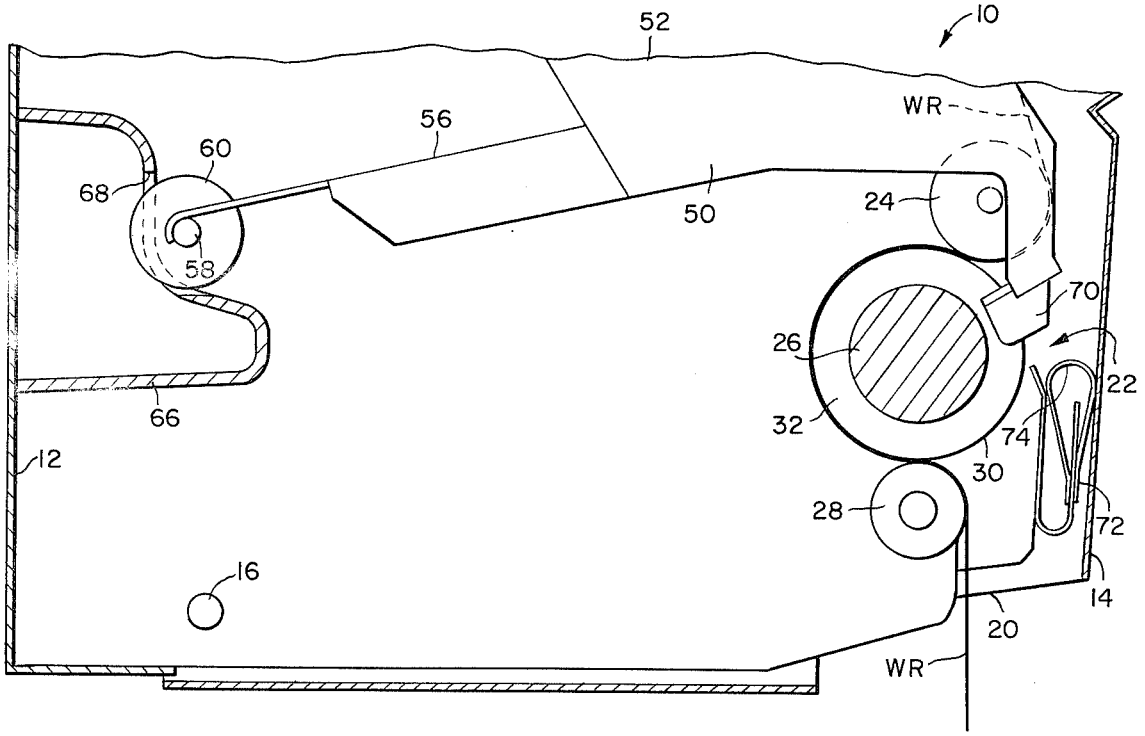
FIG. 5 is a partial section of the lower end of the dispenser with the dispensing mechanism details omitted but showing the web material from the reserve roll threaded through the mating rollers of the dispensing mechanism.

For purposes of understanding the interaction required for the instant invention between the transfer mechanism and the dispensing mechanism 22, it is sufficient to state the the mechanism 22 includes a pair of mating rollers 24 and 26, these rollers of the dispensing mechanism 22 being best seen in their relation to such mechanism 22 on FIGS. 3 and 5. As shown thereon, it will be seen that initially the web material WP supplied from primary roll P is threaded around roller 24, through the nip between rolls 24 and 26, over an auxiliary roller 28 and then led out of the opening 20 of cover 14.

In the operating state of the dispenser 10 shown on FIG. 5, the web material WP has been depleted and the web material WR has now been threaded through the nip between rollers 24 and 26, and over auxiliary roller 28 to be led out of the opening 20 of cover 14 to be available to the intending user.

As important to the functioning of the transfer mechanism in interacting with the dispensing mechanism 22, all as will be explained in detail hereinafter, the particular configuration of the roller 26 in dispensing mechanism 22 should be noted, this configuration being best seen by reference to FIGS. 2 and 5.

Thus, roller 26 of dispensing mechanism 22 is preferably characterized by having a high friction peripheral surface 30. This surface may be suitably provided by applying a roughened granular surface to the periphery of roller 26, by making roller 26 of a high friction material or by other suitable means which will grip the web material. Techniques for providing such high-friction peripheral surfaces, such as 30, in a dispenser mechanism 22 are known in the art and thus need not be further recited herein.

For the interaction desired between the transfer mechanism and dispensing mechanism 22, the roller 26 is provided with at least two annular recesses 32 which are spaced along the length of roller 26. As may be best seen on FIG. 2, four longitudinally spaced annular recesses 32 are provided along the length of roller 26 in dispensing mechanism 22. Importantly, a pair of these annular recesses 32 are spaced along the roller a distance corresponding to the spacing between tucking means provided as part of the transfer mechanism as will be described in detail hereinafter.

Whereas a specific dispensing mechanism 22 mentioned hereinabove as being disclosed in U.S. Pat. No. Re. 28,911 has been pointed to as suitable for use with this dispenser invention, it is to be understood that this form of dispensing mechanism is only illustrative. Insofar as this invention is concerned, any form of suitable dispensing mechanism to guide and lead a web of sheet material from a roll to exit the dispenser cover opening 20 may be employed subject to the dispensing mechanism selected being such as to have the above-discussed mating rollers 24 and 26 with appropriate formation of roller 26 as also described hereinabove.

Figure 2:
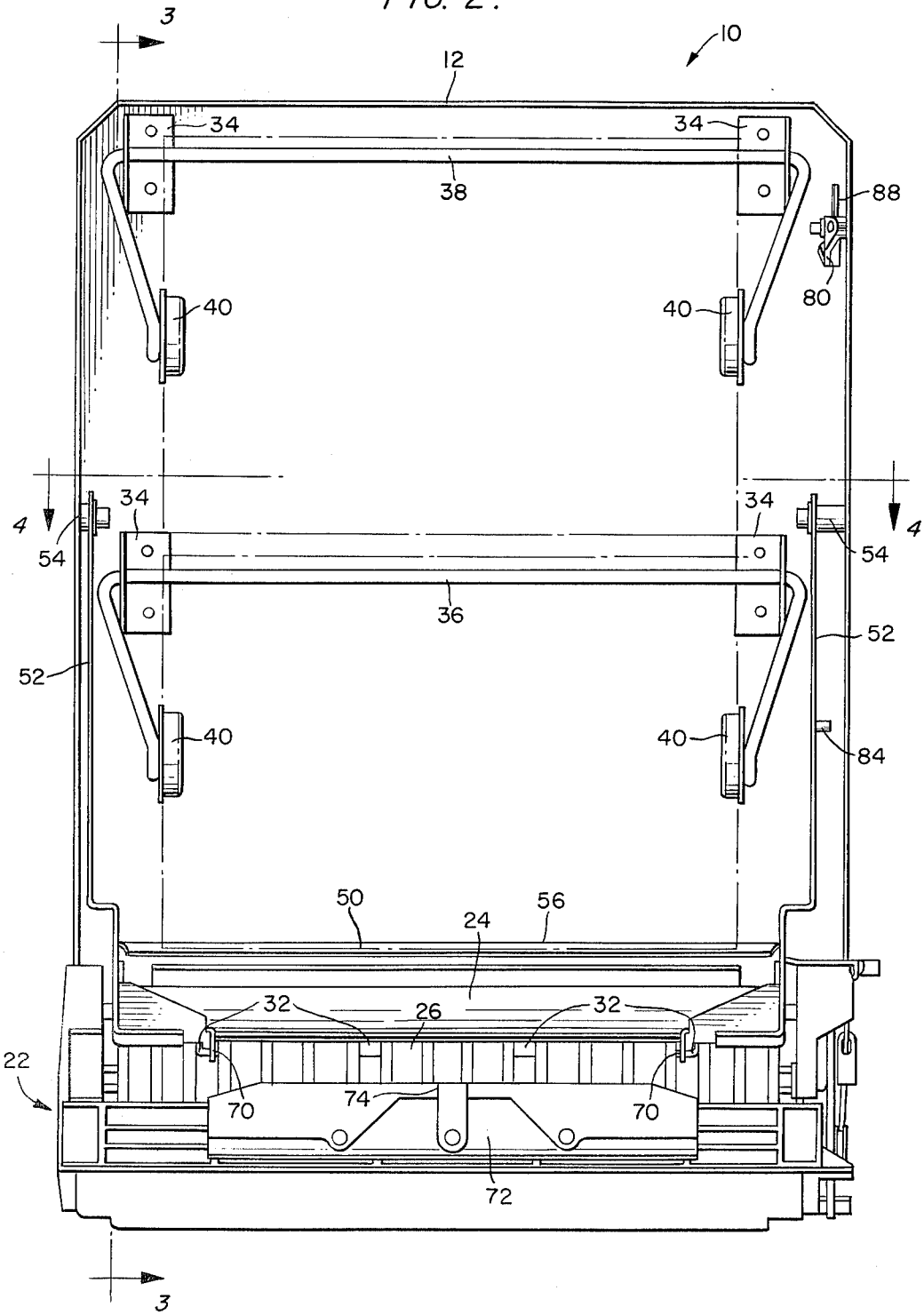
FIG. 2 is a front elevational view of the dispenser invention absent the cabinet cover with the primary and reserve rolls shown in phantom lines.

The mounting for rolls P and R within the dispenser 10 is best illustrated on FIGS. 1–3. Each of the rolls of web material will be made up of a web of flexible sheet material, such as paper toweling, wound onto a core, all as conventional in the art. Whereas the support for rolls P and R may take a variety of forms, these supports are shown as provided by angle brackets 34. These brackets may be easily riveted to the back wall of chassis 12 of the dispenser 10 at appropriate locations on the chassis as shown on FIG. 2.

Each pair of spaced brackets 34 pivotally supports a yoke, with yoke 36 providing the primary roll support for primary roll P and yoke 38 providing the reserve roll support for reserve roll R. Each yoke 36 and 38 has its central portion parallel to the back wall of chassis 12 extending through aligned openings in a pair of spaced support brackets 34. Roll support cups 40 are rotatably mounted on the outer end of each arm of the roll support yokes 36 and 38.

These cups 40 are aligned to face inwardly such that the arms of each yoke can be sprung apart and then released for the opposed cups 40 on the yoke arms to then enter the core of the roll of web material that is to be supported on the yoke. This form of mounting is fairly conventional and known in the dispenser art. Thus such need not be elaborated on with regard to support of rolls P and R on the chassis 12 of dispenser 10 in the instant invention.

It may be noted that the form of roll supports employed allow the rolls of web material to rest against the wall surface of the back of chassis 12. This provides appropriate frictional resistance against spooling or free unwinding of the roll that might occur incident rapid withdrawal of web material by the user from the dispenser 10.

The transfer mechanism which is interactive with the roll supports of yokes 36 and 38, and the dispensing mechanism 22 to automatically transfer web feed from primary roll P to reserve roll R may now be described. This transfer mechanism is provided by a transfer frame 50 that has a pair of parallel arms 52 extending along the side walls of chassis 12 to be pivotally mounted on pins 54 carried by the chassis.

Figure 4:
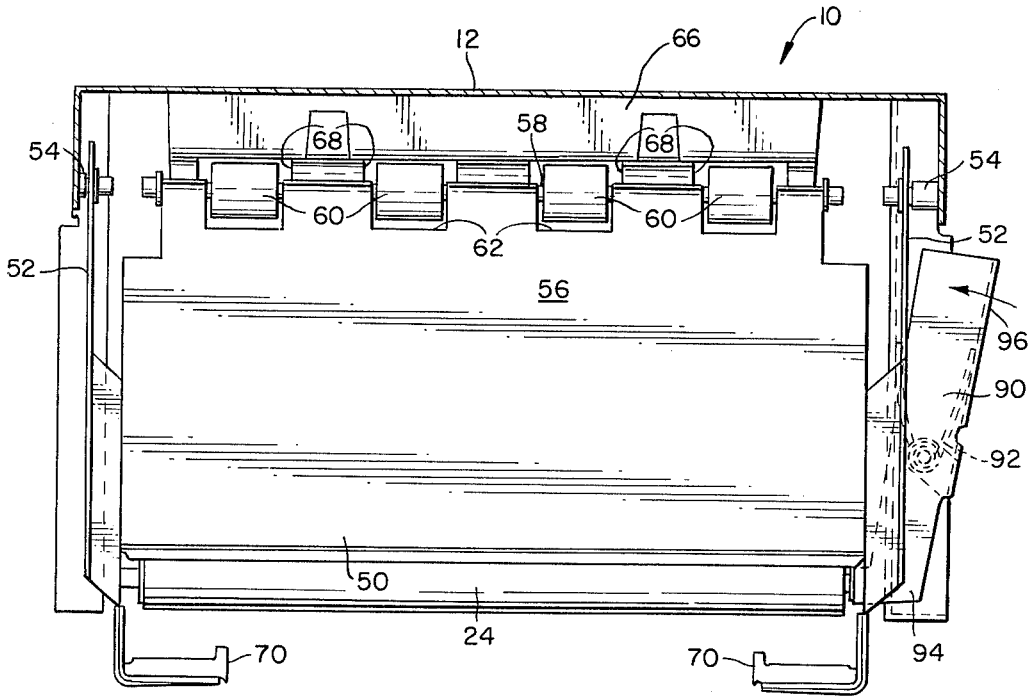
FIG. 4 is a sectional view taken on line 4—4 of FIG. 2.

Transfer frame 50 has a transverse plate member 56 extending between the ends of arms 52 which are remote from the pivot pins 54 that mount the frame 50. The end of plate member 56 that is adjacent the back wall of chassis 12 carries a spindle 58 with this spindle 58 rotatably supporting a series of spaced sensing wheels 60. As may be best seen from FIG. 4, the rearward end of plate member 56 has suitable cutouts 62 such that the spacing of the four sensing wheels 60 on spindle 58 may be easily maintained for their free rotation on the spindle while still effectively carrying out their required sensing function.

A cradle 66 is mounted on the back wall of dispenser chassis 12 to extend generally parallel to the rotational axis of sensing wheels 60 as mounted spindle 58 that is carried by the transfer frame 50. Cradle 66 has a series of spaced apertures 68 which correspond in number and spacing to the number and spacing of the sensing wheels 60 carried by spindle 58.

By comparison of the positional relationships between the parts shown on FIG. 3 and corresponding parts as shown on FIG. 5, an understanding of the web sensing function for wheels 60 in relation to the apertures 68 of cradle 66 will be obtained. In FIG. 3, the web WP being supplied from primary roll P is passing between the wheels 60 and cradle 66, thereby covering the apertures 68 of cradle 66. This web then extends around the rollers 24, 26 and 28 of dispensing mechanism 22 where it exits through aperture 20 of the dispenser cabinet cover 14. On the other hand, in FIG. 5 the web material WP supplied from primary roll P has been exhausted. Thus, it is not present beneath the rollers 60 to cover the apertures 68 in cradle 66. Accordingly, in FIG. 5 the sensing wheels 60 have entered apertures 68 resulting in the transfer frame 50 having shifted to its final position wherein the tucking means carried by the transfer frame 50 has performed its function to press a web end portion of the reserve roll web material WR into the recesses 32 of roller 26 of the dispensing mechanism 22, all as will be described in more detail hereinafter.

The transfer frame 50 carries a pair of spaced tucking fingers 70 generally located at the ends of arms 52 outwardly of the plate member 56 which carries sensing wheels 60. As so positioned on the forward end of transfer frame 50, the tucking fingers 70 are spaced to correspond with the spacing between a pair of the annular recesses 32 on the roller 26 of dispensing mechanism 22. Thus, when web material such as web WP supplied from primary roll P is interposed between the sensing wheels 60 and apertures 68 of cradle 66 as shown on FIG. 3, the transfer frame 50 and therefore tucking finger 70 carried thereby is retained in the position shown in solid lines on FIG. 3.

On the other hand, when the web material WP is depleted, the apertures 68 of cradle 66 are exposed for the sensing wheels 60 to thereupon enter these apertures resulting in the transfer frame 50 shifting the tucking fingers 70 into the annular recesses 32 of dispensing roller 26 in the manner illustrated on FIG. 5. This shift of the transfer frame 50 has the effect of automatically transferring web feed from the primary roll P when web WP is exhausted to web feed coming from reserve roll R.

The transfer action occurs when frame 50 shifts and tucking fingers 70 act to fold the web end portion WR into the recesses 32 of feed roller 26. Thereafter, as the rollers 24, 26 and 28 of dispensing mechanism are turned incident withdrawal of web material through slot 20, as by the pull applied to the web by the intending user, the frictional surface of feed roller 26 will pick up web WR as it has been folded into the annular recesses 32 of the roller 26 and draw this web into the nip between the mating rollers 24 and 26. Thereafter, web material WR will be fed as supplied from the reserve roll R.

To be assured of effective pickup of the web end from reserve roll R by the action of the transfer mechanism caused by the abovementioned final shift of transfer frame 50, the provision of holding means in the form of bracket 72 is important. Bracket 72 is carried by the chassis 12 of dispenser 10 as by the bracket being fixedly secured along the forward end of the dispensing mechanism 22. Bracket 72 functions to hold a web end portion of material WR supplied from reserve roll R until the transfer frame 50 shifts to coact with dispensing mechanism 22. As described, this shift causes tucking fingers 70 to fold the web end portion into the annular recesses 32 of feed roller 26 such that thereafter rotation of this feed roller effectively picks up the web end portion, drawing it out of holding bracket 72 to feed it through the dispensing mechanism and out of slot 20 to be supplied to the user.

Bracket 72 provides a trough extending laterally along the front of the dispenser 10 into which the free web end portion of web WR is to be loosely inserted as part of the attendant's actions in loading the dispenser 10 with multiple rolls of web material. The trough provided by bracket 72 simply and effectively instructs the attendant in loading the reserve roll R to properly locate the lead end of its web WR to be loosely received in this trough.

In addition, the bracket 72 has a spring clip 74 which bows in a loop extending above the outer edge of bracket 72. This clip 74 is disposed in a location such that the act of pivoting cabinet cover 14 on its pivots 16 to its closed position as shown in FIG. 3 causes the bowed spring clip 74 of bracket 72 to firmly grip the web end portion which has heretofore been loosely received and held in the trough provided by bracket 72. Thus, when the attendant has completed loading the dispenser 10 and thereupon closes the cabinet cover 14, the action of bracket 72 in being squeezed to its closed gripping position by this cover closing action assures that the end of web WR is firmly gripped. As so gripped, it is maintained in the proper location during the period of web usage from the dispenser of material coming from primary roll P, web WP being threaded through the dispensing mechanism 22 and withdrawn in the relation of the parts as shown on FIG. 3.

When the cover 14 is again opened in connection with needed replenishment of rolls P and/or R, the bracket 72 and its spring clip 74 springs open incident the action of cover opening for the bracket 72 to again be ready to loosely receive and hold a web end portion inserted in the trough of bracket 72. Thus, the end portion of web WR is led off of the fresh roll R mounted on the upper roll support yoke 38 and loosely introduced into the trough of bracket 72.

The transfer frame 50 through its pivotal mounting on pins 54 carried by the side walls of the dispenser chassis 12 is swingable to be out of the way to facilitate dispenser loading with the dispenser cabinet cover 14 open. Additionally, these swinging movements of the transfer frame 50 assist in properly threading the webs of material coming from the primary and reserve rolls P and R to simplify dispenser loading. Transfer frame 50 is swingable to separate locations whereat loading rolls P and R on the roll supports provided by yokes 36 and 38 is facilitated. Retaining means are operable at each of these locations with these retaining means for the transfer frame 50 being carried by the dispenser chassis 12.

Figure 6:
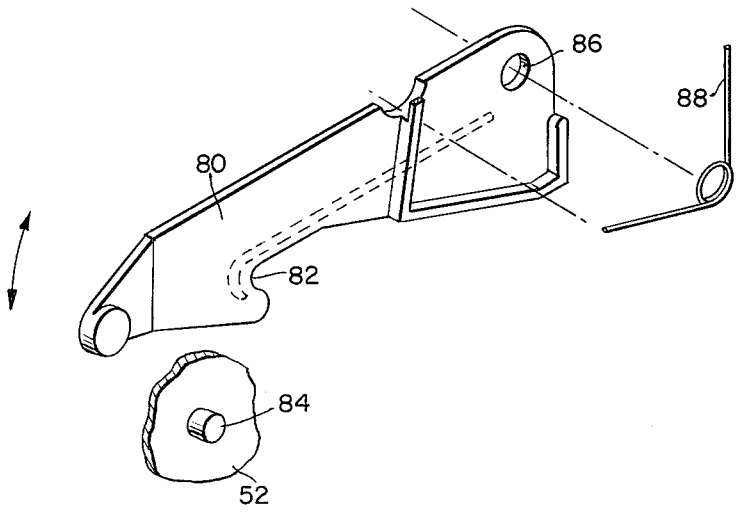
FIG. 6 is an exploded perspective view of the manually operated latch which holds the transfer frame out of the way to facilitate dispenser loading.
Figure 7:
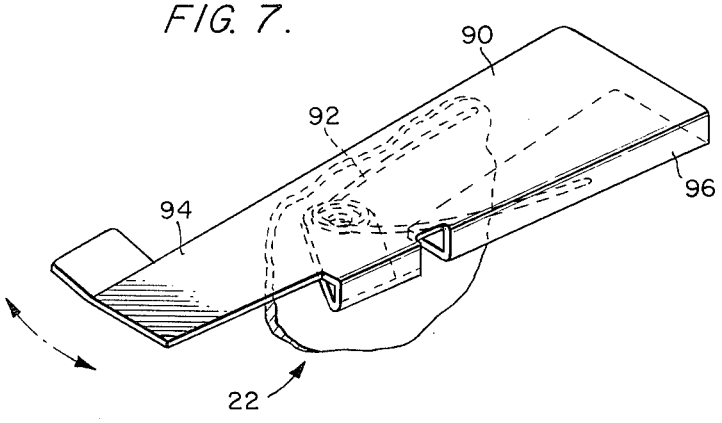
FIG. 7 is a perspective view of the latch which retains the transfer frame in an intermediate location for dispenser loading and which is automatically released by closing the dispenser cabinet cover.

As shown on FIG. 1, the transfer frame 50 is retained in a fully elevated location by a manual latch 80 having a hook 82 with this hook retainingly engaging with a pin 84 carried by one of the arms 52 of the transfer frame 50. As shown on FIG. 6, latch 80 is constructed with a pivot 86 by means of which it is pivotally mounted on one side wall of the dispenser chassis 12. A biasing spring 88 is associated with latch 80 to urge the latch downwardly into latching engagement between its hook 82 and pin 84 carried by an arm 52 of transfer frame 50.

FIG. 1 also shows the transfer frame 50 in a phantom line position to which the frame 50 swings upon manual release of the latch 80. This separate location for retention of the transfer frame 50 is also provided with an automatic latching means to hold the frame 50 in this phantom line position until this latter latching means is released by the act of closing the cabinet cover 14.

This automatic latching means is provided by a latch 90 which is suitably mounted to pivot in a horizontal plane about a vertical pivot pin that may be appropriately mounted on an end wall of the dispenser mechanism 22. Latch 90 has a spring 92 associated with its pivotal mounting pin which acts to swing latch 90 into the position as shown on FIG. 4 whereat the forward end portion 94 of latch 90 underlies the end of one arm 52 when the transfer frame 50 swings downwardly into its phantom line position as shown on FIG. 1. In this position, the latch 90 serves to hold the transfer frame 50 so that web WR supplied from reserve roll R may expeditiously be threaded into the bracket 72 beneath the tucking fingers 70 of the transfer frame 50 in carrying out proper loading of the dispenser 10 with respect to roll R.

The latch 90 also provides a trailing wall portion 96 which projects laterally outwardly beyond the side wall of dispenser chassis 12. While latch 90, acting through its forward portion 94, serves to retain transfer frame 50 in the phantom line position as shown on FIG. 1, when the cabinet cover 14 of dispenser 10 is pivoted about pivots 16 in being moved to its closed position, the act of closing cover 14 brings the cover side wall into sliding engagement with the wall portion 96 of latch 90. This movement swings latch 90 such that the portion 94 thereof is moved out from beneath its holding position relative to the arm 52 of transfer frame 50, thereby allowing the transfer frame to move to its sensing location.

The sensing position is the one in which transfer frame 50 is shown on FIG. 3. The web WP coming from primary roll P has been properly threaded to cover the apertures 68 of cradle 66 with the sensing wheels 60 carried by transfer frame 50 holding such frame in the position shown on FIG. 3.

In addition to releasing latch 90 from its holding of frame 50 in the phantom position shown on FIG. 1, the closure of cabinet cover 14 to the position shown on FIG. 3 activates the spring clip 74 of holding bracket 72 so that the web end portion of web WR coming from reserve roll R is firmly gripped against displacement. Furthermore, the web end portion extends upwardly beneath the tucking fingers 70 in readiness for activation of the transfer frame 50 when the sensing wheels 60 detect exhaustion of web material WP coming from roll P.

In this relation as shown on FIG. 3, the presence of cabinet cover 14 lying closely adjacent tucking fingers 70 of transfer frame 50 is beneficial in blocking any tendency of the transfer frame 50 to shift forwardly. This forward shift might occur by excess or too rapid pulling force being applied to the web material WP but this force will not result in the transfer frame moving out of position since undesired frame shift is blocked by cabinet cover 14 in its closed state.

When web material WP supplied from primary roll P is exhausted, the dispenser structure assumes a condition of the parts as shown on FIG. 5. In this condition, the sensing wheels 60 carried on spindle 58 of the transfer frame 50 have entered the apertures 68 of cradle 66 carried by the dispenser chassis 12. The transfer frame 50 has shifted to its final position whereat tucking fingers 70 have folded the web end portion of web WR coming from reserve roll R into the annular recesses 32 of feed roller 26. Rotation of the rollers 24, 26 and 28 in conjunction with dispenser mechanism 22 operation have picked up the leading web end portion and carried it through the dispenser mechanism 22 for web WR to be available beyond slot 20 of the cover 14 for the intending user.

The above detailed description of the multiple roll dispenser 10 would clearly indicate the operational features of such dispenser in carrying out its ability to dispense in succession web material from a primary roll and then web material from a reserve roll after material on the primary roll has been depleted. A brief summarization of techniques which may be advantageously employed in loading and reloading the multiple roll dispenser 10 may now be given.

With the dispenser 10 in empty condition, the cabinet cover 14 will be opened and the transfer frame 50 swung to its uppermost position, as shown on FIG. 1, where it will be retained by the manually releasable latch 80. A full roll P will be loaded onto the support yoke 36 in the primary dispensing position and the web end from this roll threaded into the mating rollers 24 and 26 of dispensing mechanism 22. This threading can be achieved by manual manipulation of the conventional dispensing wheel of dispensing mechanism 22. This will place web WP in readiness for dispensing as shown on FIG. 1.

Thereafter, the manual latch 80 will be released and the transfer frame 50 swung downwardly to its position shown in phantom lines on FIG. 1. In this location, a fresh roll R may be most easily loaded onto the support yoke 38 at the reserve dispensing position. The web WR from this roll R will be led downwardly in front of roll P with the web end portion thereof threaded beneath the tucking fingers 70 on frame 50 and then loosely inserted into the bracket 72 at the front of the dispensing mechanism 22.

With the dispenser loading so completed, the cover 14 may be swung up to its closed position and cover lock 18 actuated. As previously noted, the act of closing cover 14 will automatically release latch 90 to free the transfer frame 50 for it to move to its sensing location such as shown on FIG. 3. The presence of cover 14 immediately in front of transfer frame 50 will block undesirable movement of the transfer frame as web material is withdrawn from the primary roll P. Closure of cabinet cover 14 also activates the clip 74 of bracket 72 such that the end portion of web WR is firmly gripped by bracket 72 to keep web WR in proper location for pickup when the sensing wheels 60 sense the depletion of web material WP.

Whereas one appropriate technique for loading the multiple roll dispenser 10 has been generally described hereinabove, it will be appreciated that the techniques for loading rolled web material rolls into the dispenser 10 may take a variety of approaches. These approaches will vary depending upon such factors as whether the dispenser is fully exhausted of rolled web material, the desires of the attendant in carrying out dispenser loading, etc.

It will be understood that in disclosing the preferred embodiment illustrated on the drawings and described hereinabove, it is contemplated that many variations and changes or different constructions may be employed in utilizing the invention other than those shown and described herein. These variations, changes and modifications are contemplated to be within the scope of the concepts of the invention. Accordingly, it should be realized that the scope of the invention is not limited by the description and the illustrations presented in this application, but is governed only by the scope of the appended claims.

We claim:

1. A dispenser for multiple rolls of web material such as paper toweling and the like comprising:

a dispenser chassis adapted to be attached to a wall at a location for web material use, said chassis having primary and reserve support means to rotatably support rolls in primary and reserve dispensing positions, respectively;

a dispenser mechanism on said chassis including mating rollers to lead a web of material out of the dispenser to a user, at least one of said mating rollers having an annular recess formed intermediae the ends thereof;

transfer frame means pivotally mounted on said chassis to swing about an axis parallel to the rotative axes for the rolls as defined by said support means, said frame means having sensing means to sense depletion of web material supplied from the roll carried by said primary support means and tucking means to press a web end portion of the material supplied from the roll carried by said reserve support means into said dispensing mechanism upon such web depletion being sensed, said tucking means being disposed to press the web end portion into said annular recess;

retaining means on said chassis for releasibly retaining said frame means out of the way to facilitate loading rolls onto said support means at said dispensing positions; and web holding means mounted on said chassis to hold to said chassis a web end portion of the material from a roll in reserve dispensing position until said transfer frame means coacts with said dispensing mechanism to feed web material supplied from such roll.

2. A dispenser as recited in claim 1 wherein at least one of said mating rollers is characterized by having a high friction peripheral surface.

3. A dispenser as recited in any one of claims 1 or 2 wherein said tucking means includes a pair of spaced tucking fingers on said transfer frame means, and one of said mating rollers has a pair of annular recesses spaced therealong corresponding to the spacing between said fingers for said fingers to fold the web end portion into said recesses when said transfer frame means coacts with said dispensing mechanism.

4. A dispenser for multiple rolls of web material such as paper toweling and the like comprising:

a dispenser chassis adapted to be attached to a wall at a location for web material use, said chassis having primary and reserve support means to rotatably support rolls in primary and reserve dispensing positions, respectively;

a dispensing mechanism on said chassis including mating rollers to lead a web of material out of the dispenser to a user;

transfer frame means pivotally mounted on said chassis to swing about an axis parallel to the rotative axes for the rolls as defined by said support means, said frame means having sensing means to sense depletion of web material supplied from the roll carried by said primary support means and tucking means to press a web end portion of the material supplied from the roll carried by said reserve support means into said dispensing mechanism upon such web depletion being sensed, said sensing means including spaced sensing wheels and a cradle, said wheels being rotatably mounted on said transfer frame means, said wheels being disposed intermediate said primary support means and said dispensing mechanism, and said cradle being mounted on said chassis parallel to the rotational axis of said sensing wheels, said cradle having apertures therein spaced in correspondence with the spacing of said sensing wheels whereby web material passing between said wheels and said cradle functions to support said sensing wheels against entering said apertures;

retaining means on said chassis for releasibly retaining said frame means out of the way to facilitate loading rolls onto said support means at said dispensing positions; and holding means carried by said chassis to hold a web end portion of the material from a roll in reserve dispensing position until said transfer frame means coacts with said dispensing mechanism to feed web material supplied from such roll.

5. A dispenser as recited in claim 4 wherein said tucking means includes a pair of spaced tucking fingers on said transfer frame means, and one of said mating rollers has a pair of annular recesses spaced therealong corresponding to the spacing between said fingers for said fingers to fold the web end portion into said recesses when said transfer frame means coacts with said dispensing mechanism.

6. A dispenser for multiple rolls of web material such as paper toweling and the like comprising:

a dispenser chassis adapted to be attached to a wall at a location for web material use, said chassis having primary and reserve support means to rotatably support rolls in primary and reserve dispensing positions, respectively;

a dispensing mechanism on said chassis including mating rollers to lead a web of material out of the dispenser to a user;

transfer frame means pivotally mounted on said chassis to swing about an axis parallel to the rotative axes for the rolls as defined by said support means, said frame means having sensing means to sense depletion of web material supplied from the roll carried by said primary support means and tucking means to press a web end portion of the material supplied from the roll carried by said reserve support means into said dispensing mechanism upon such web depletion being sensed, said frame means being swingable to separate locations whereat loading rolls on said support means is facilitated;

retaining means on said chassis for releasibly retaining said frame means out of the way to facilitate loading rolls onto said support means at said dispensing positions, said retaining means including latching means operable for each of said separate locations; and holding means carried by said chassis to hold a web end portion of the material from a roll in reserve dispensing position until said transfer frame means coacts with said dispensing mechanism to feed web material supplied from such roll.

7. A dispenser as recited in claim 6 wherein said chassis has a cabinet cover pivotally mounted thereon to be opened for dispenser loading, and at least one of said latching means is released by the act of closing said cover to free said transfer frame means to move to a sensing location whereat said sensing means is activated.

8. A dispenser for multiple rolls of web material such as paper toweling and the like comprising:

a dispenser chassis adapted to be attached to a wall at a location for web material use, said chassis having primary and reserve support means to rotatably support rolls in primary and reserve dispensing positions, respectively;

a dispensing mechanism on said chassis including mating rollers to lead a web of material out of the dispenser to a user;

transfer frame means pivotally mounted on said chassis to swing about an axis parallel to the rotative axes for the rolls as defined by said support means, said frame means having sensing means to sense depletion of web material supplied from the roll carried by said primary support means and tucking means to press a web end portion of the material supplied from the roll carried by said reserve support means into said dispensing mechanism upon such web depletion being sensed;

retaining means on said chassis for releasibly retaining said frame means out of the way to facilitate loading rolls onto said support means at said dispensing positions; and holding means carried by said chassis to hold a web end portion of the material from a roll in reserve dispensing position until said transfer frame means coacts with said dispensing mechanism to feed web material supplied from such roll, said holding means including a bracket which loosely receives the web end portion, said chassis having a cabinet cover pivotally mounted thereon, said cover and said bracket being disposed so that upon closing said cover the bracket acts to firmly grip such web end portion until the transfer frame means coacts with said dispensing mechanism.

9. A dispenser as recited in claim 8 wherein said frame means is swingable to separate locations whereat loading rolls on said support means is facilitated, and said retaining means includes latching means operable for each of said locations.

10. A dispenser as recited in claim 10 wherein at least one of said latching means is mounted on said chassis to be released by the act of closing said cover to free said transfer frame means to move to a sensing location whereat said sensing means is activated.

* * * * *